US005080995A

United States Patent [19]

Fox et al.

[11] Patent Number: 5,080,995

[45] Date of Patent: Jan. 14, 1992

[54] PROCESSES FOR TONER PIGMENT DISPERSION

[75] Inventors: Carol A. Fox, Farmington; Jacques C. Bertrand, Onatrio, both of N.Y.

[73] Assignee: Xerox Corporation, Stamford, Conn.

[21] Appl. No.: 545,810

[22] Filed: Jun. 29, 1990

[51] Int. Cl.[5] ..... G03G 9/087; G03G 9/107

[52] U.S. Cl. ..... 430/137; 430/126

[58] Field of Search ..... 430/110, 126, 108, 106, 430/904, 137

[56] References Cited

U.S. PATENT DOCUMENTS

| | | | |
|---|---|---|---|
| 3,165,420 | 1/1965 | Tomanek et al. | 117/17.5 |
| 3,234,017 | 2/1966 | Heyl et al. | 96/1 |
| 3,236,776 | 2/1966 | Tomanek | 252/62.1 |
| 3,652,315 | 3/1972 | Matsuo et al. | 117/17.5 |
| 3,655,374 | 4/1972 | Palermiti et al. | 96/1.4 |
| 3,983,045 | 9/1976 | Jugle et al. | 252/62.1 P |
| 4,298,672 | 11/1981 | Lu | 430/108 |
| 4,338,390 | 7/1982 | Lu | 430/106 |
| 4,535,049 | 8/1985 | Honda et al. | 430/137 |
| 4,560,635 | 12/1985 | Hoffend et al. | 430/106.6 |
| 4,656,111 | 4/1987 | Wakamiya et al. | 430/109 |
| 4,833,056 | 5/1989 | Bhateja et al. | 430/106.6 |
| 4,855,207 | 8/1989 | Tsubuko et al. | 430/109 |
| 4,859,550 | 8/1989 | Gruber et al. | 430/39 |
| 4,883,736 | 11/1989 | Hoffend et al. | 430/110 |
| 4,910,114 | 3/1990 | Hosino et al. | 430/106.6 |
| 4,971,882 | 11/1990 | Jugle | 430/110 |

*Primary Examiner*—John Goodrow
*Attorney, Agent, or Firm*—E. O. Palazzo

[57] ABSTRACT

A process for enabling effective toner pigment dispersion which comprises dry blending toner resin, pigment, and a polymeric alcohol of the formula $$CH_3(CH_2)_nCH_2OH$$

wherein n is a number of from about 15 to about 300; subsequently melt processing the aforementioned mixture by heating; cooling the mixture formed; micronizing the formed toner product and thereafter accomplishing classification thereof.

33 Claims, No Drawings

PROCESSES FOR TONER PIGMENT DISPERSION

BACKGROUND OF THE INVENTION

This invention is generally directed to toner and developer compositions, and more specifically the present invention is directed to processes for pigment, especially colored pigment dispersion in toner compositions, including magnetic, single component, and colored toner compositions by the utilization of polymeric alcohol waxes. In one embodiment, the process of the present invention enables improved pigment dispersion with toner compositions which are comprised of resin particles, pigment particles, and waxes with hydroxyl functionality, reference U.S. Pat. No. 4,883,736 issued Nov. 28, 1989, the disclosure of which is totally incorporated herein by reference. There is also provided in accordance with the present invention processes for improved pigment dispersion with positively or negatively charged toner compositions comprised of resin particles, pigment particles, and charge enhancing additives. Furthermore, there is provided in accordance with the present invention processes for pigment dispersion with toner compositions wherein the polymeric alcohol waxes are preferably present therein as internal additives. In an embodiment, the present invention is directed to processes for improved pigment dispersion with developer compositions comprised of the aforementioned toners, and carrier particles. Furthermore, in another embodiment of the present invention there are provided single component toner compositions comprised of resin particles, magnetic components such as magnetites, and waxes with hydroxyl functionality. The toner and developer compositions illustrated herein are useful in electrostatographic imaging systems, especially those systems wherein blade cleaning of the photoconductive member is accomplished. Moreover, the toner and developer compositions of the present invention enable the photoconductive imaging member present in an imaging apparatus to function for extended time periods, for example, up to 100,000 cycles while simultaneously preventing the localized accumulation of undersirable toner debris thereon which can encompass sufficient areas of the photoconductive members to permitting unwanted toner spots to be present on the final developed output copy. Further, the developer compositions of the present invention in an embodiment thereof possess stable electrical properties for extended time periods, and with these compositions, for example, there is no substantial change in the triboelectrical charging values, and substantially no degradation in $A_f$ which is the product of the toner concentration +1 multiplied by the triboelectric charging value. Therefore, the units of measurement (μc percent/grams) for $A_f$ are ± microcoulombs of charge on the toner particles multiplied by the percent toner concentration divided by grams of the toner particles that are separated from the developer composition by, for example, known blowing processes, which units are dependent on a number of factors inclusive of the composition of the carrier particles selected. Accordingly, thus the $A_f$ for the developer compositions of the present invention in an embodiment thereof remains at, for example, from about 60 to about 80 for 300,000 developed images or copies while simultaneously maintaining high copy quality for each of the aforementioned images. There is permitted with the compositions of the present invention a prolonged charge exchange capability thereby contributing to a more stable development system requiring less complex control systems, and reduced maintenance of the imaging apparatus within which the compositions are incorporated. In addition, the aforementioned compositions provide for an increase in the latitudes over which a blade cleaning system can operate thereby enabling a more reliable and simpler apparatus.

By increased latitude, it is intended to refer to the achievement of obtaining an increase in the range of the load or force applied to the blade between a lower value wherein cleaning will fail, and an upper value wherein the blade undesirably bends causing the tip thereof to remain out of contact with the imaging member. Moreover, with increased latitude there can be selected a broader range of imaging member cleaning blade thicknesses, and various blade orientations with respect to the imaging member.

Improved pigment dispersion refers in an embodiment of the present invention to obtaining uniform dispersion of pigments including carbon black, colored pigments such as red, blue, green, cyan, magenta, yellow, brown and mixtures thereof and wherein there is avoided or minimized the formation of pigment agglomerates or domains, rather the dispersion is substantially uniform. More specifically, with colored pigment in an embodiment of the present invention the dispersion thereof and the toner composition is very uniform with no agglomerations of particles having an average diameter of larger than about 0.5 micron as compared to, for example, pigment agglomerates of greater than an average diameter of 1.5 microns when the polymeric alcohol wax illustrated herein is not selected. Improved pigment dispersion in the toner compositions enables a number of advantages including superior color intensity for the resulting developed images and transparency efficiency, which results were evidenced by, for example, electron photomicrographs. Accordingly, in an embodiment of the present invention the toner compositions with the polymeric alcohol wax enable better transparency efficiency, improved color intensities and resolutions and permit lower concentrations of pigment to be selected especially with respect to obtaining effective color intensities for the images developed with the aforementioned toners.

Developer and toner compositions with certain waxes therein, and imaging proceses thereof are known. For example, there are disclosed in U.K. Patent Publication 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, issued Jan. 18, 1972, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43. Toner compositions containing polymeric alcohol waxes are disclosed in U.S. Pat. No. 4,883,736, the disclosure of which is totally incorporated herein by reference, and these waxes can be selected for the processes of the present invention.

In a patentability search report the following U.S. Pat. Nos. were listed: 4,883,736, which discloses toners with a polymeric alcohol of the formula as recited in the Abstract of the Disclosure for example, and wherein the alcohol can be selected as an internal or external additive, see column 10 for example; 4,859,550 which discloses smear resistant image character recognition processes with toners comprised of a polymeric alcohol, reference for example the Abstract of the Disclosure; 4,656,111 discloses a pressure fixable toner with long carbon chain compounds, including fatty alcohols to enhance dispersion of a pigment in a toner, see column 4 for example; 3,234,017 discloses a long chain alcohol as a toner additive, see column 4 for example; 3,165,420, 3,236,776, and 4,535,049 relating to the addition of waxes to toners; and as background interest 3,652,315, 4,833,056, 4,855,207, and 4,910,114.

Described in U.S. Pat. No. 4,367,275 are methods of preventing offsetting of electrostatic images of the toner composition to the fuser roll, which toner subsequently offsets to supporting substrates such as papers wherein there is selected toner compositions containing specific external lubricants including various waxes, see column 5, lines 32 to 45.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014 and 4,394,430, the disclosures of which are totally incorporated herein by reference.

There is a need for processes with improved pigment dispersion with toner compositions with certain waxes, which compositions are useful in electrostatic imaging processes. In addition, there is a need for processes that enable improved color pigment dispersion with toner and developer compositions that maintain their triboelectrical characteristics for extended time periods, exceeding for example 100,000 developed images. Furthermore, there is a need for processes that enable improved color pigment dispersion with single component toners, and low melting toner resins, that possess many of the aforementioned characteristics. Also, there is a need for processes that enable improved color pigment dispersion with toner and developer compositions with certain toxicologically safe and economical waxes therein that allow the aforementioned advantages, and other advantages to be obtained in embodiments of the present invention.

SUMMARY OF THE INVENTION

It is a feature of the present invention to provide processes with toner and developer compositions which possess many of the advantages illustrated herein.

Another feature of the present invention resides in the provision of excellent toner pigment dispersions with toner and developer compositions containing polymeric hydroxy compounds.

In another feature of the present invention there are provided processes that permit improved colored pigment dispersions in toner compositions.

Furthermore, in another feature of the present invention there are provided processes that permit improved pigment dispersions with positively charged and negatively charged toner compositions which compositions are useful for the development of images present on positively or negatively charged imaging members.

Additionally, in yet another feature of the present invention there are provided processes that permit excellent pigment dispersions with toner and developer compositions with certain polymeric alcohols therein or thereon.

In another feature of the present invention there are provided processes that permit improved pigment dispersions with positively charged toner compositions with certain waxes therein or thereon, which compositions are useful for causing the developement of electrostatic latent images, including color images.

In yet another feature of the present invention there are provided processes that permit improved pigment dispersions with single component toner compositions with certain waxes therein or thereon.

Additionally, in still another feature of the present invention there are provided methods for the development of images, including colored images with toner that possess improved pigment dispersions.

These and other features of the present invention can be accomplished by providing processes with excellent toner pigment dispersions. More specifically, the present invention is directed to processes wherein the pigment selected is dispersed in an effective amount in toner compositions comprised of resin particles and waxes with hydroxyl functionality. Furthermore, there are provided in accordance with the present invention processes for improved pigment dispersion with positively or negatively charged toner compositions comprised of resin particles, pigment particles, polymeric alcohol waxes, and charge enhancing additives. Another embodiment of the present invention is directed to the use of developer compositions comprised of the aforementioned toners; and carrier particles.

The proces of the present invention in one embodiment enables improved pigment dispersion by mixing toner resin particles, pigment particles, especially colored pigment particles, and a polymeric alcohol of the formula as illustrated herein wherein n is from about 15 to about 400, preferably from about 30 to about 300, and more preferably in a specific embodiment of from about 27 to about 50. Usually the wax is present as an internal additive.

In accordance with embodiments of the present invention, there are selected for improved pigment dispersion developer compositions comprises of toner compositions containing resin particles, particularly styrene butadiene resins, pigment particles such as magnetites, carbon blacks, colored pigments, inclusive of red, brown, blue, green, cyan, magenta, yellow, or mixtures thereof, polymeric hydroxy waxes available from Petrolite as detailed hereinafter, which waxes are incorporated into the toner compositions as internal additives and optional charge enhancing additives, particularly for example distearyl dimethyl ammonium methyl sulfate, reference U.S. Pat. No. 4,560,635, the disclosure of which is totally incorporated herein by reference, and carrier particles. As carrier components for the aforementioned compositions, there can be selected various known materials such as iron, steel, especially Toniolo steel, ferrites, and the like, with an optional polymeric coating thereover including the coatings as illustrated in U.S. Ser. No. 751,922 (now abandoned) (D/83155), and the corresponding Japanese equivalent thereof, entitled Developer Composition with Specific Carrier Particles, the disclosures of which are totally incorporated herein by reference. One particulary preferred coating illustrated in the aforementioned application is comprised of a copolymer of vinyl chloride and trifluorochloroethylene with conductive substances dispersed in the polymeric coating inclusive of, for example, carbon black. One embodiment disclosed in the aforementioned application is a developer composition comprised of styrene butadiene copolymer resin particles, pigment, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers.

In one embodiment of the present invention there is provided a process for improving the pigment dispersion, which process comprises by dry blending using drum tumbling resin particles, pigment particles, including carbon black, colored pigments, and magnetites, charge control additives, and the polymeric alcohols illustrated herein; melt processing the aforementioned dry blend with, for example, a Banbury rubber mill, an extruder, or other melt blending processes; cooling the resulting product and subsequently crushing, micronizing and classifying enabling, for example, toner particles with an average diameter of from about 10 to about 20 microns, and preferably from about 10 to about 15 microns average particle diameter as determined by a Coulter Counter. The aforementioned produced toners may be surface treated with additives such as Aerosils, metal salts of fatty acids or metal salts including zinc stearate, other lubricants such as Kynar, and moreover additional polymeric alcohol may be added to the surface of the resulting toner. The aforementioned additives are generally present on the surface in an effective amount, usually from about 0.1 to about 3 weight percent, and preferably about 1 weight percent. In another embodiment of the present invention, the process comprises pretreating the pigments with the polymeric alcohol illustrated herein, which alcohol is available from Petrolite Corporation, by, for example, dissolving the alcohol in an organic solvent such as toluene and subsequently adding the pigment. Thereafter, the solvent is removed by, for example, vacuum drying and the treated pigment is added with the other toner components, such as resin and optional charge enhancing additive, and these components are then melt processed, micronized and classified as illustrated herein.

Illustrative examples of suitable toner resins selected for the toner and developer compositions useful in the processes of the present invention, and present in various effective amounts such as, for example, from about 70 percent by weight to about 95 percent by weight, include polyesters, styrene acrylates, styrene methacrylates, polyamides, epoxy resins, polyurethanes, polyolefins, vinyl resins and polymeric esterification products of a dicarboxylic acid and a diol comprising a diphenol. Various suitable vinyl resins may be selected as the toner resin including homopolymers or copolymers of two or more vinyl monomers. Typical vinyl monomeric units include styrene, p-chlorostyrene, vinyl naphthalene, unsatruated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; mixtures thereof, and the like. Toner resins include styrene butadiene copolymers, especially styrene butadiene copolymers prepared by a suspension polymerization process reference, U.S. Pat. No. 4,558,108, the disclosure of which is totally incorporated herein by reference; crosslinked resins including styrene acrylates, and styrene methacrylates crosslinked with divinyl benzene; and mixtures thereof. Also, there may be selected as toner resins styrene butylmethacrylates with a low molecular weight wax, for example a weight average molecular weight of from about 1,000 to about 6,000,such as polypropylene or polyethylene, which waxes may be chemically grafted to the resin.

As one toner resin there can be selected the esterification products of a dicarboxylic acid and a diol comprising a diphenol, which components are illustrated in U.S. Pat. No. 3,590,000, the disclosure of which is totally incorporated herein by reference. Other specific toner resins include styrene/methacrylate copolymers, styrene/acrylate copolymers, styrene butylmethacrylates with a low molecular weight wax, for example a weight average molecular weight of from about 1,000 to about 6,000, such as polypropylene or polyethylene, which waxes are chemically grafted to the resin; and styrene/butadiene copolymers, especially those as illustrated in the aforementioned '108 patent; and styrene butadiene resins with high styrene content, that is exceeding from about 80 to 85 percent by weight of styrene, which resins are available as Pliolites® from Goodyear Chemical Company; Plitones® polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol.

Numerous well known suitable pigments can be selected as the colorant for the toner particles including, for example, carbon black, nigrosine dye, aniline blue, phthalocyanine derivatives, magnetites, other colored pigments as illustrated herein, and mixtures thereof. The pigment should be present in a sufficient amount to render the toner composition colored thereby permitting the formation of a clearly visible image. Generally, the pigment particles are present in amounts of from about 3 percent by weight to about 20 percent by weight, based on the total weight of the toner composition, however, lesser or greater amounts of pigment particles can be selected.

When the pigment particles are comprised of magnetites, including those commercially available as Mapico Black, they are present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black. Particularly preferred as pigments are magnetites as they enable, for example, images with no toner spots for extended time periods exceeding the development of 100,000 images, which corresponds to about 400,000 imaging cycles for a panel containing four imaging members.

Also encompassed within the scope of the present invention are processes with colored toner compositions containing as pigments or colorants red, blue, green, brown, magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as Cl 60710, Cl Dispersed Red 15, a diazo dye identified in the Color Index as Cl 26050, Cl Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Permanent Yellow FGL, and the like. These pigments are generally present in the toner composition in an amount of from about 2 weight percent to about 15 weight percent based on the weight of the toner resin particles.

Illustrative examples of optional charge enhancing additives present in various effective amounts, such as for example from about 0.1 to about 20 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; orthohalo carboxylic acids, aluminum complex charge enhancing additives; and the like, including other charge enhancing additives which will assist or impart a negative charge to the toner composition; and the like. Generally, the triboelectric charge on the toner is from a positive or negative about 10 to about 40 and preferably from about 15 to about 30 microcoulombs per gram as determined in the known charge spectrograph apparatus or in the known Faraday Cage apparatus.

With further respect to the toner and developer compositions, an important component that enables it is believed the advantages of improved pigment dispersion is the linear polymeric alcohol comprised in an embodiment of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 15 to about 300, preferably of from about 30 to about 100, and more preferably from about 27 to about 50, which alcohols are available from Petrolite Corporation. Particularly preferred polymeric alcohols include those wherein n represents a number of from about 30 to about 50. In an embodiment of the present invention the polymeric alcohols selected have a number average molecular weight as determined by gas chromatography of from about greater than 285 to about 1,400, and preferably of from about 475 to about 750. In addition, the aforementioned polymeric alcohols are present in the toner and developer compositions illustrated herein in various effective amounts, and can be added as uniformly dispersed internal additives. More specifically, the polymeric alcohols are present in an amount of from about 0.05 percent to about 20 percent by weight. As internal additives the polymeric alcohols are usually present in an amount of from about 0.5 percent by weight to about 20 percent by weight. Toner and developer compositions with the waxes present internally are formulated by initially blending the toner resin particles, pigment particles, and polymeric alcohols, and other optional components.

Although it is not desirable to be limited by theory, it is believed that the aforementioned linear polymeric alcohols possess very narrow polydispersity, that is the ratio of $M_w/M_n$ is equal to or less than about 1.1 in one embodiment; and moreover, these alcohols possess high crystallinity with a density of about 0.985. By high crystallinity is meant that the linear polymeric alcohol molecular chains possess a high degree of molecular order in their solid state molecular structure; and also possess zero to very few defects in this ordered molecular structure, reference for example the text of *Macromolecule Structure and Properties*, Vol. 1, authored by Hans Georg Elias (1984), particularly Chapter 5, pages 151 to 154. In addition, the alcohols of the present invention possess the appropriate hardness and toughness properties enabling the resulting toner and developer compositions to be readily attritable to fine particle sizes of less than, for example, about 15 micrometers average diameter. The aforementioned polymeric alcohols and toners containing these alcohols are disclosed in U.S. Pat. No. 4,883,736, the disclosure of which is totally incorporated herein by reference.

Illustrative examples of carrier particles that can be selected for mixing with the toner compositions include those particles that are capable of triboelectrically obtaining a charge of opposite polarity to that of the toner particles. Accordingly, the carrier particles can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccuring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922 (now abandoned) (D/83155) relating to developer compositions with certain carrier particles, the disclosure of which is totally incorporated herein by reference. More specifically, there are illustrated in the aforementioned application carrier particles comprised of a core with a coating thereover of vinyl polymers, or vinyl homopolymers. Examples of specific carriers illustrated in the abandoned application, and useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidene fluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trifluorochloroethylene; and other known coatings. There can also be selected as carriers components comprised of a core with a polymer mixture coating thereover, which polymers are not in close proximity in the triboeletric series, reference U.S. Pat. Nos. 4,937,166 and 4,935,326, the disclosures of which are totally incorporated herein by reference. More specifically, there is detailed in these patents a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles. Coating weight can vary and is usually present in an effective known amount, such as for example from about 0.1 to about 5, and preferably from about 0.1 to about 3 weight percent. The coating weight can be from about 0.1 to about 5 weight percent, and preferably from about 0.5 to 2 weight percent in an embodiment of the present invention.

Also, while the size of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, including from about 1 to about 5 parts of toner to about 10 parts to about 200 parts by weight of carrier.

The toner compositions of the present invention can be prepared by a number of known methods, including mechanical blending and melt blending the toner resin particles, pigment particles or colorants, and polymeric alcohols followed by mechanical attrition. Other methods include those well known in the art such as spray drying, mechanical dispersion, melt dispersion, dispersion polymerization, and suspension polymerization. In one dispersion polymerization method, a solvent dispersion of the resin particles, the pigment particles, polymeric alcohols, and charge enhancing additive are spray dried under controlled conditions to result in the desired product. With further respect to the present invention, the polymeric alcohols are preferably added as internal additives, that is the toner compositions comprised of, for example, resin particles, pigment particles, and polymeric alcohol, preferably in a finely divided form are admixed with heat in a Banbury apparatus, or an extrusion device. Micronization is usually accomplished by known methods utilizing, for example, fluid energy mills and optional classification can be accomplished with, for example, sieves or other known means, to enable for example toner particles with a known diameter of from about 10 to about 25 microns.

The toner and developer compositions may be selected for use in developing images in electrostatographic imaging systems, containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990. Moreover, there can be selected as photoconductors hydrogenated amorphous silicon; and as photogenerating pigments squaraines, perylenes; and the like.

Additionally, the toner and developer compositions with improved pigment dispersion are particularly useful with electrostatographic imagining apparatuses containing a development zone situated between a charge transporting means and a metering charging means, which apparatus is illustrated in U.S. Pat. Nos. 4,394,429 and 4,368,970, the disclosures of which are totally incorporated herein by reference. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the present of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating magnetic carrier particles, means for causing the flexible imaging means to move at a speed of from about 5 centimeters/second to about 50 centimeters/second, means for causing the transporting means to move at a speed of from about 6 centimeters/second to about 100 centimeters/second, the means for imaging and the means for transporting moving at different speeds; and the means for imaging and the means for transporting having a distance therebetween of from about 0.05 millimeter to about 1.5 millimeters.

Specific embodiments of the invention will now be described. These examples are intended to be illustrative, and the invention is not limited to the materials, conditions, or process parameters set forth in these embodiments. Also, comparative Examples are presented. All parts and percentages are by weight unless otherwise indicated.

EXAMPLE I

There was prepared by melt blending in a BR Farrel Banbury Melt Mixer, followed by mechanical attrition in a Model 0202 Jet-O-Miser Fluid Energy Mill and classified using a Donaldson Model B Classifier, a toner composed of 90 percent by weight of styrene butadiene resin (89/11) and 10 percent by weight BP(black pearls)-1300 carbon black. The average volume diameter particle size of the toner was 11.51 microns, with an average number of 7.10 microns, with removal of fines less than between 4 to 6 microns as determined by Coulter Counter. When examined by electron transmission microscopy, the carbon black dispersion was uneven with numerous large carbon black agglomerates of from 0.25 to 1.5 microns present as determined by electron transmission microscopy.

EXAMPLE II

A toner was prepared by repeating the procedure of Example I with the exceptions that there was incorporated as an internal component 5 percent by weight of a linear polymeric alcohol, available from Petrolite Corporation, of the formula illustrated herein with a number average molecular weight of about 700, that is where n is a number of about 48 as determined by gas chromatography, and 85 percent of the styrene butadiene resin. The average volume diameter particle size of the toner was 9.98 microns, with an average number of 6.45 microns, with removal of fines less than between 4 to 6 microns as determined by Coulter Counter. When examined by electron transmission microscopy, the carbon black dispersion was uniform with no large carbon black agglomerates of greater than 0.25 micron present as determined by electron transmission microscopy.

EXAMPLE III

A toner was prepared by repeating the procedure of Example II with the exception that there was incorporated as an internal component 5 percent by weight of a linear polymeric alcohol, available from Petrolite Corporation, of the formula illustrated herein with a number average molecular weight of about 425, that is where n is a number of about 27 as determined by gas chromatography. The particle size of the toner was average volume of 10.32 microns, and average number of 6.88 microns, with removal of fines less than between 4 to 6 microns as determined by Coulter Counter. When examined by electron transmission microscopy, the carbon black dispersion was uniform with no large carbon black agglomerates of greater than 0.25 micron present as determined by electron transmission microscopy.

EXAMPLE IV

A toner was prepared by repeating the procedure of Example I with the exception that 90 percent by weight of styrene n-butyl methacrylate resin was selected in place of the styrene butadiene resin. The particle size of the toner was average volume of 10.58 microns, and average number of 7.01 microns, with removal of fines less than between 4 to 6 microns as determined by Coulter Counter. When examined by electron transmission microscopy, the carbon black dispersion was uneven with numerous large carbon black agglomerates of from 0.5 to 1.0 microns present as determined by electron transmission microscopy.

EXAMPLE V

A toner was prepared by repeating the procedure of Example IV with the exceptions that there was incorporated as an internal component 5 percent by weight of a linear polymeric alcohol, available from Petrolite Corporation, of the formula illustrated herein with a number average molecular weight of about 700, that is where n is a number of about 48 as determined by gas chromatography, and 85 percent by weight of resin. The particle size of the toner was average volume of 12.30 microns, and average number of 7.21 microns, with removal of fines less than between 4 to 6 microns as determined by Coulter Counter. When examined by electron transmission microscopy, the carbon black dispersion was uniform with no large carbon black agglomerates of greater than 0.25 micron present as determined by electron transmission microscopy.

EXAMPLE VI

A toner was prepared by repeating the procedure of Example I with the exception that 90 percent by weight of a polyester of propoxylated bisphenol A fumarate resin was selected in place of the styrene butadiene resin. The particle size of the toner was average volume of 11.13 microns, and average number of 6.89 microns, with removal of fines less than between 4 to 6 microns as determined by Coulter Counter. When examined by electron transmission microscopy, the carbon black dispersion was uneven with numerous large carbon black agglomerates of from 0.25 to 1.5 microns present as determined by electron transmission microscopy.

EXAMPLE VII

A toner was prepared by repeating the procedure of Example IV with the exception that the carbon black was 10 percent R5750 and there was incorporated as an internal component 5 percent by weight of a linear polymeric alcohol, available from Petrolite Corporation, of the formula illustrated herein with a number average molecular weight of about 425, that is where n is a number of about 27 as determined by gas chromatography, and 85 percent by weight of resin The particle size of the toner was average volume of 12.53 microns, and average number of 6.85 microns, with removal of fines less than between 4 to 6 microns as determined by Coulter Counter. When examined by electron transmission microscopy, the carbon black dispersion was uniform with no large carbon black agglomerates of greater than 0.5 micron present as determined by electron transmission microscopy.

EXAMPLE VIII

A magenta pigment (Hostaperm Pink, American Hoechts Corporation) was preblended with Unilin TM 700 of Example II at a 50/50 weight ratio. There was prepared by repeating the process of Example I, including melt blending, followed by mechanical attrition, a toner comprised of 90 percent by weight of styrene butadiene resin (89/11), and 10 percent by weight of the aforementioned prepared pigment wax preblend for a total pigment loading of 5 percent. When examined by electron transmission microscopy, the pigment dispersion was even with no large agglomerates present. The average particle size was less than 0.5 micron.

EXAMPLE IX

There was prepared a toner by repeating the process of Example VIII except that the magenta pigment was not pretreated with Unilin TM . When examined by electron transmission microscopy, the pigment dispersion was uneven with large agglomerates present. The average particle size was greater than 1.0 micron with many agglomerates larger than 1.5 microns as determined by electron transmission microscopy.

EXAMPLE X

A yellow pigment (Novaperm Yellow FGL, American Hoechts Corporation) was preblended with Unilin TM 700 of Example II at a 50/50 weight ratio. There was prepared by repeating the procedure of Example IX including melt blending, followed by mechanical attrition, a toner comprised of 90 percent by weight of styrene butadiene resin (89/11), and 10 percent by weight of the pigment wax preblend for a total pigment loading of 5 percent. When examined by electron transmission microscopy, the pigment dispersion was even with no large agglomerates present. The average particle size was less than 0.5 micron.

EXAMPLE XI

There was prepared a toner by repeating the process of Example X except that the yellow pigment was not pretreated with wax. When examined by electron transmission microscopy, the pigment dispersion was uneven with large agglomerates present. The average particle size was greater than 1.0 microns with many agglomerates larger than 1.5 microns as determined by electron transmission microscopy.

EXAMPLE XII

A toner composition was prepared by repeating the procedure of Example X with the exception that a cyan pigment was used (PV Fast Blue from American Hoechts Corporation) in place of the yellow. The results were essentially the same as those reported in Example X.

EXAMPLE XIII

A toner composition was prepared by repeating the procedure of Example XII with the exception that a cyan pigment was not pretreated. The results were essentially the same as reported in Example XI.

EXAMPLE XIV

A toner composition was prepared by repeating the procedure of Example VIII with the exception that Unilin 425 TM was used in place of the Unilin 700 TM . The results were essentially the same as those reported in Example VIII.

EXAMPLE XV

A toner composition was prepared by repeating the procedure of Example X with the exception that a Unilin 425 TM was used in place of the Unilin 700 TM . The results were essentially the same as those reported in Example X.

EXAMPLE XVI

A toner composition was prepared by repeating the procedure of Example XII with the exception that Unilin 425 TM was used in place of the Unilin TM 700. The results were essentially the same as reported in Example XII.

EXAMPLE XVII

A toner composition was prepared by repeating the procedure of Example III with the exception that Hostaperm Pink was used instead of carbon black. When examined by electron transmission microscopy, the pigment dispersion was even with no large agglomerates present. The average particle size was less than 0.5 micron.

Other modifications of the present invention may occur to those skilled in the art subsequent to a review of the present application. The aforementioned modifications, including equivalents thereof are intended to be included within the scope of the present invention.

What is claimed is:

1. A process for enabling effective toner pigment dispersion which comprises dry blending toner resin, pigment, and a polymeric alcohol of the formula $$CH_3(CH_2)_nCH_2OH$$

wherein n is a number of from about 15 to about 300; subsequently melt processing the aforementioned mixture by heating; cooling the mixture formed; micronizing the formed toner product and thereafter accomplishing classification thereof.

2. A process in accordance with claim 1 wherein the pigment is selected from the group consisting of carbon black, red, green, blue, brown, cyan, yellow, magenta, and magnetite.

3. A process in accordance with claim 1 wherein the melt processing is accomplished in a Banbury rubber. mill.

4. A process in accordance with claim 1 wherein the melt processing is accomplished in an extrusion apparatus.

5. A process for improving toner pigment dispersion which comprises initially treating a toner pigment with a polymeric alcohol of the formula $$CH_3(CH_2)_nCH_2OH$$

wherein n is a number of from about 15 to about 300 and subsequently added the resulting treated pigment to resin particles.

6. A process in accordance with claim 1 wherein n is a number of from about 30 to about 50.

7. A process in accordance with claim 1 wherein the polymeric alcohol has a number average molecular weight of from about 475 to about 2,000.

8. A process in accordance with claim 1 wherein the polymeric alcohol is present as an internal component.

9. A process in accordance with claim 1 wherein the polymeric alcohol is present in an amount of from about 0.05 percent by weight to about 20 percent by weight.

10. A process in accordance with claim 1 wherein the resin particles are selected from the group consisting of polyesters, styrene butadiene copolymers, styrene acrylate copolymers, and styrene methacrylate copolymers.

11. A process in accordance with claim 1 wherein the resin particles are comprised of a polyester obtained from a propoxylated bisphenol A fumarate.

12. A process in accordance with claim 11 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

13. A process in accordance with claim 1 wherein the resin particles are comprised of a styrene methacrylate with a wax grafted thereto.

14. A process in accordance with claim 7 wherein the wax is polypropylene or polyethylene.

15. A process in accordance with claim 1 wherein the pigment particles are carbon black.

16. A process in accordance with claim 1 wherein the pigment particles are magnetite.

17. A process in accordance with claim 1 wherein the pigment particles are comprised of a mixture of carbon black and magnetites.

18. A process in accordance with claim 1 wherein the pigment particles are selected from the group consisting of red, green, blue, brown, magenta, cyan, yellow, and mixtures thereof.

19. A process in accordance with claim 1 wherein the resulting toner contains a charge enhancing additive.

20. A process in accordance with claim 19 wherein the charge, enhancing additive is selected from the group consisting of distearyl dimethyl ammonium methyl sulfate, cetyl pyridinium halides, and stearyl phenethyl dimethyl ammonium tosylate.

21. A process in accordance with claim 19 wherein the charge enhancing additive is distearyl dimethyl ammonium methyl sulfate.

22. A process in accordance with claim 19 wherein the pigment particles are comprised of a mixture of carbon black and magnetite.

23. A process in accordance with claim 1 wherein there is added to the rersulting toner carrier particles.

24. A process in accordance with claim 23 wherein the carrier particles are comprised of a core with a polymeric coating thereover.

25. A process in accordance with claim 23 wherein the carrier particles are comprised of a steel of a ferrite core with a coating thereover selected from the group consisting of polytrifluorochloroethylene-covinylchloride copolymer, a polyvinylidene fluoropolymer, a terpolymer of styrene, methacrylate, and an organo silane, fluorinated ethylenepropylene copolymers, and polytetrafluoroethylene.

26. A process in accordance with claim 24 wherein the polymeric coating is comprised of a first and a second polymer not in close proximity in the triboelectric series.

27. A process in accordance with claim 25 wherein the first coating is polyvinylidene fluoride, and the second coating is polymethyl methacrylate.

28. A method for obtaining images which comprises generating an electrostatic latent image on a photoconductive imaging member, subsequently affecting development of this image with the toner composition of claim 1, thereafter transferring the image to a permanent substrate, and optionally permanently affixing the image thereto.

29. A method for obtaining images which comprises generating an electrostatic latent image on a photoconductive imaging member, subsequently affecting development of this image with the toner composition of claim 2, thereafter transferring the image to a permanent substrate, and optionally permanently affixing the image thereto.

30. A method for obtaining images which comprises generating an electrostatic latent image on a photoconductive imaging member, subsequently affecting development of this image with the developer composition of claim 3, thereafter transferring the image to a permanent substrate, and optionally permanently affixing the image thereto.

31. A process in accordance with claim 1 wherein n is a number of from about 25 to about 50.

32. A process in accordance with claim 1 wherein n is a number of from about 25 to about 50.

33. A process in accordance with claim 1 wherein n is a number of from about 25 to about 50.

* * * * *